United States Patent [19]

Seidler

[11] Patent Number: 4,597,625

[45] Date of Patent: Jul. 1, 1986

[54] ELECTRICAL CONNECTOR

[75] Inventor: Jack Seidler, Flushing, N.Y.

[73] Assignee: North American Specialties Corporation, College Point, N.Y.

[21] Appl. No.: 634,299

[22] Filed: Jul. 25, 1984

[51] Int. Cl.[4] ..... H01R 13/11; H01R 13/514

[52] U.S. Cl. ..... 339/176 M; 339/17 LC; 339/221 M

[58] Field of Search ..... 339/176 M, 204, 205, 339/220 R, 221 R, 221 M, 258 R, 258 P, 278 C, 276 SF, 17 LC

[56] References Cited

U.S. PATENT DOCUMENTS

| | | | |
|---|---|---|---|
| 3,673,548 | 6/1972 | Mattingly, Jr. et al. | 339/221 M |
| 3,688,243 | 8/1972 | Yamada et al. | 339/176 M |
| 3,761,871 | 9/1973 | Teurlings | 339/221 R |
| 4,183,611 | 1/1980 | Casciotti et al. | 339/278 C |
| 4,410,230 | 10/1983 | San Miguel | 339/176 M |
| 4,411,486 | 10/1983 | Behrendt | 339/258 R |

*Primary Examiner*—John McQuade

*Attorney, Agent, or Firm*—Darby & Darby

[57] ABSTRACT

An electrical connector has a molded body for receiving one or more contacts. Each contact is formed from a flat strip by simple multiple stamping, and has a single contact-making tongue extending into a channel of the body which receives a mating pin contact. The arrangement is economically plated only on the tongue portion. The contact is adapted for either front or rear connection by having a terminal leg formed at each end of the contact body, only one selected leg being used.

7 Claims, 11 Drawing Figures

ELECTRICAL CONNECTOR

The present invention relates to multiple-contact electrical connectors, and more particularly to improved contacts and housings for such connectors.

For joining multiple-conductor cables to one another, or connecting such cables to printed circuit boards, it has become customary to use multi-terminal connectors. The present invention deals with a receptacle connector adapted for use with convention multi-pin plug connectors, such as those using square 0.025 inch pins, on 0.100 or 0.156 inch centers.

One form of customary receptacle for the pin of such connectors has been a so-called box connector in which a flat piece of conductive material is bent into the form of a box, with resilient tongues pressed inwardly of two opposite walls of such a box, to engage resiliently with a pin when it is inserted within the central channel of such a box. While such box terminals are effective in making connection with pin-type terminals, the formation of the box terminal is a complex multiple-stamping operation, particularly difficult in requiring performing operations on the workpiece out of a single plane, as when the side walls or top of the box may be formed.

In addition, in many instances it is necessary to coat or plate the contact, for purposes of avoiding corrosion or of making good electrical connection with the mating pin. In the case of contacts like box contacts, such a plating operation must as a practical matter be done before the contact is formed. This in turn requires plating large areas of conductive material, much of which is wasted when stamped out of a sheet or strip when forming the contact, resulting in excess cost, which can be particularly undesirable when such plating uses expensive metals, such as gold or rhodium. Alternatively, plating of the entire contact after formation is required, which also involves plating of substantial areas, and offers difficulty in plating at the inside of the terminal.

The present invention provides a much simplified contact arrangement, having many of the advantages of the box terminal, while eliminating important disadvantages, particularly with respect to complexity of formation of the terminal by stamping and with respect to cost of plating. According to the present invention, contacts for a receptacle connector adapted to receive conventional terminal pins of a mating connector may be made by simplified stamping operations essentially in a single plane. Also, the design of the present invention makes it possible to coat or plate only the actual small areas of the contact which form the connection with the mating pin, thereby accomplishing increased economy and and reduced cost.

According to another feature of the invention, a connector for use with mating connector pins extending in a horizontal direction or parallel to a mounting panel, may be formed with two rows of contacts, which are specifically different but formed simultaneously by the same operations from a single master contact strip.

Yet another feature of the invention resides in the design of a connector body or housing useful for either horizontal or vertical mounting, with contacts having terminals extending outwardly from one or the other end of a channel extending through the housing from a pin-entry side to an opposite side.

Other advantages and benefits of the present invention will become more apparent from consideration of the following description and the accompanying drawings, in which.

Figure 1:
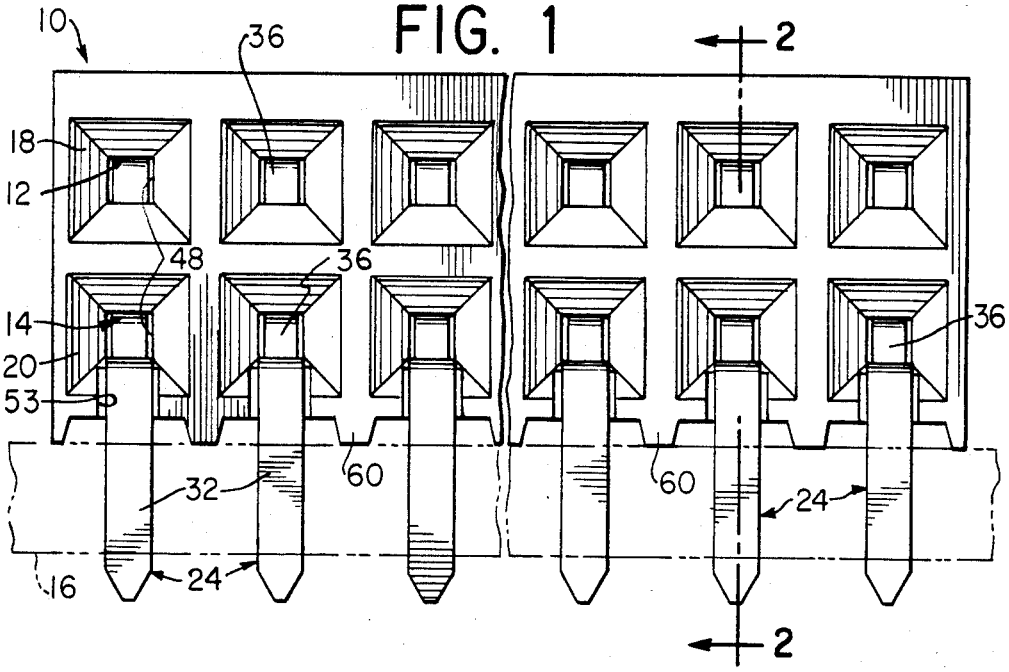
FIG. 1 shows a front elevation view of a connector incorporating the present invention, mounted horizontally.

Referring to FIGS. 1 to 9, the form of the invention here shown comprises a connector body or housing 10 with a number of channels 12 in an upper row and a like number of channels 14 in a lower row. In this form of the invention, the channels run generally horizontally when the connector is mounted on a panel 16, such as a printed circuit board or other mounting panel. Each of the channels 12 and 14 is provided with an entrance opening 18, 20 which is tapered as shown, and adapted to guide a mating square pin 62 of conventional form, which may be mounted in a mating pin connector, for insertion into channels 12, 14.

Each of the channels 12, 14 contains a contact 22 or 24 of special configuration for making good electrical connection to the mating pin 62 when the latter is inserted into the housing channel 12 or 14.

Figure 5:
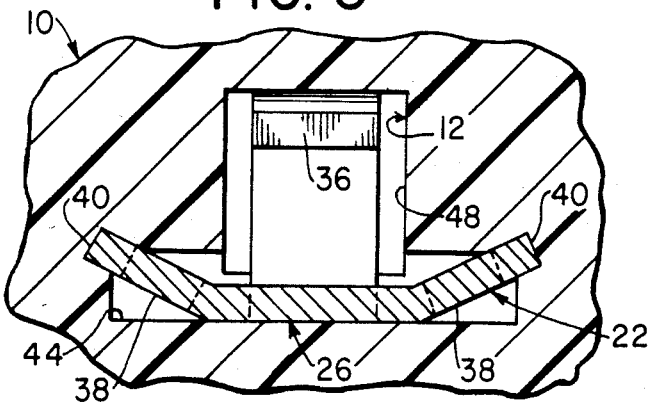
FIG. 5 is an enlarged fragmentary elevation cross-sectional view of a portion of FIG. 2 viewed along line 5—5 thereof.
Figure 6:
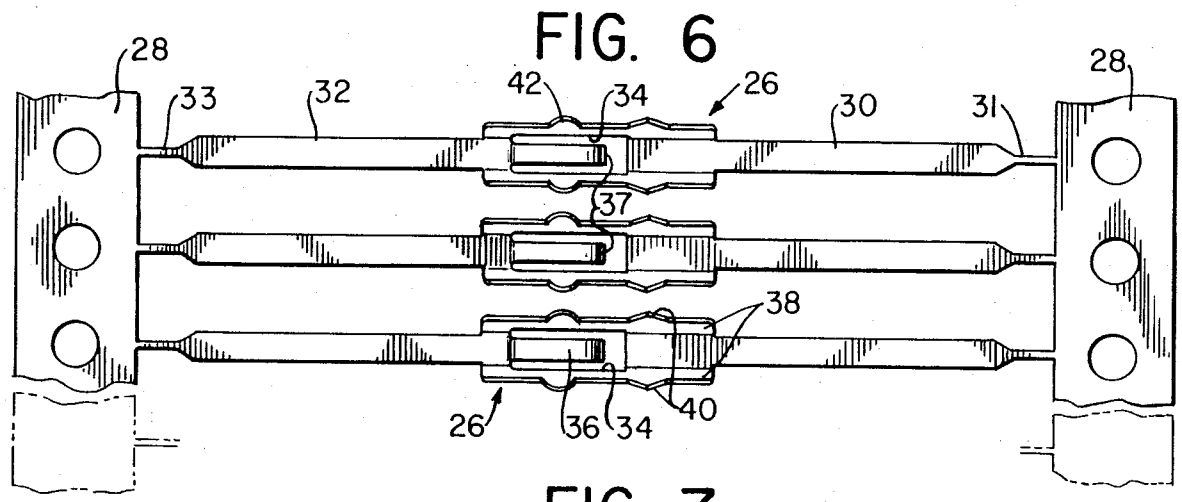
FIG. 6 shows a plan view of a continuous strip of contacts useful in the invention.

The nature of the contacts 22 or 24 will be more readily apparent from FIG. 6, which shows a strip of master contacts which are the result of a multiple stamping operation, for forming the contacts 22 or 24 from a sheet or wide strip of beryllium copper or other conductive material, which is preferably resilient. As shown in FIG. 6, the contact bodies 26 are formed integrally with two carrier strips 28, being joined thereto by terminal strips 30, 32 and severable joining sections 31,33. The contact body 26 is formed with a punched-out opening 34 forming a frame into which projects a contact tongue 36, bent upwardly from the plane of the contact body 26 as shown more clearly in FIG. 2. The contact tongue 36 is a single cantilever beam extending from one side of the frame formed by the contact body. The frame forms an anchoring means for the contact tongue. Thus, each of the sides 38 of the contact body 26 is formed with a sharp triangular projection 40, in one region, and a rounded projection 42 opposite the resilient tongue 36. The sides 38 of the contact body 26 extending laterally beyond the terminal strips 30, 32 are bent slightly upwardly, as shown in FIG. 5.

The rounded projections 42 are such that the overall width of the contact body 26 at the position of these projections is very slightly greater than the width of the channel 44 intended to receive the contact. In this way, the contact may be inserted readily into the channel 44 with relatively slight force (such as by hand), increasing the slight bowing of the contact transversely of its length, and producing a small but sufficient retention frictional force to hold the contact within the channel 44 temporarily. Moreover, the frame arrangement surrounding the contact tongue provides, in effect, twin elliptical springs to provide retaining force against the walls of the housing. The contact body width at the location of the rounded projections 42 is slightly less than the body width at the location of the pointed projections 40. Thus, the connector, with contacts initially partially inserted, may have the contact driven home by a greater force, such as by machine. In doing so, the pointed projections 40, having a slightly wider separation or width than the rounded projections 42, will dig into the side walls of the contact-receiving channel 44, to hold the contact firmly within the connector housing, and prevent ready removal of the contact from the housing. The resiliency of the contact material, with the bowing imposed on the contact body, causes the contact body to act as an elliptical spring to exert outward force against the walls of the channel and thereby retain the contact within the channel by the enhanced friction thus caused. In general, upon full insertion of the contact body 26 into the housing 10, the sharp projections 40 will dig into the walls of the contact receiving channel 44 to wedge the contact 26 therein.

The connector housing 10 has a series of channels 12, 14 running therethrough. These channels are essentially in the shape of an inverted T having a very stubby center leg 48. The center leg 48 of the inverted-T channel is formed to conform to the mating pin and constitutes a pin-receiving channel. For example, where the mating pin is of square cross-section (e.g. 0.025 inches on a side) the channel may be slightly larger, such as 0.03 inches. The flat "top" of the inverted-T channel is wider than the pin-receiving channel 48, and forms a contact-receiving channel 44. By way of example, for a connector of the type just described, which may be formed from a 0.006 inch thick strip, this channel may be 0.067 inches wide and 0.008 inches high. The pin-receiving channels may be spaced 0.100 inches on centers to accommodate the standard 0.025 inch square pins of a multiple-pin connector.

Figure 2:
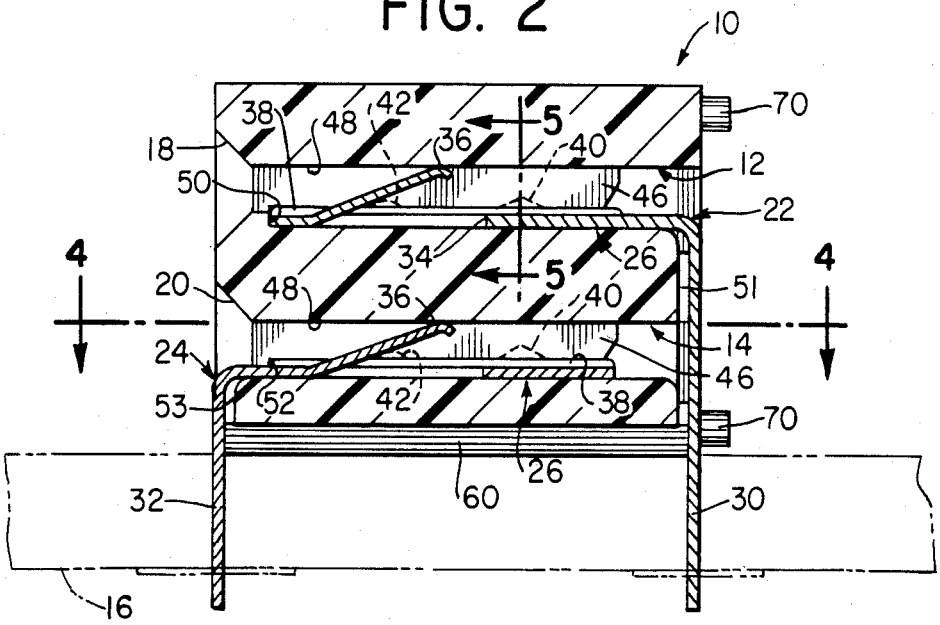
FIG. 2 is a cross-sectional view of the device of FIG. 1 taken along line 2—2 thereof.
Figure 3:
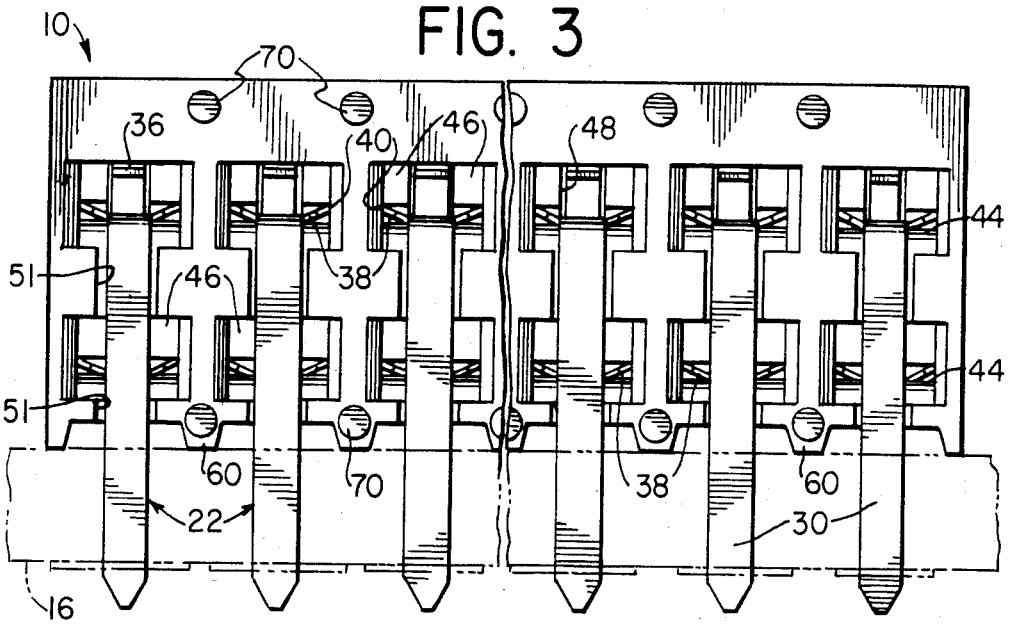
FIG. 3 is a rear elevation view of the device of FIGS. 1 and 2.
Figure 4:
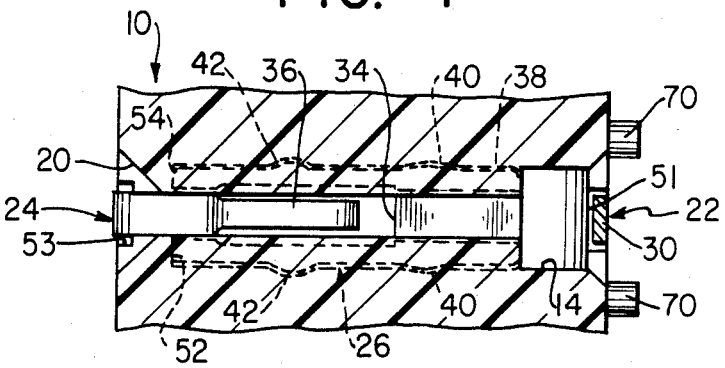
FIG. 4 is a fragmentary cross-sectional view of the device of FIG. 2 taken along line 4—4 thereof and showing a plan view of the contact portion of the connector.
Figure 7:
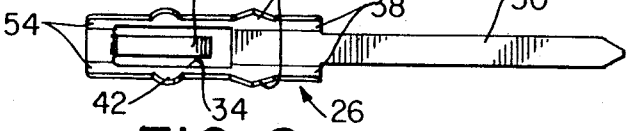
FIG. 7 shows a plan view of a rear contact of the connector.

According to one aspect of the invention, the master contact strip shown in FIG. 6 provides both the contacts for the upper channel 12 of FIG. 2 and the contacts for the lower channel 14 of FIG. 2. For the upper channel 12 of FIG. 2, the contact strip of FIG. 6 is trimmed as shown in FIG. 7, to form a contact whose body 26 has the terminal strip 30 to the right thereof. This contact is then inserted into the housing of FIG. 2 from the right-hand side, with the resilient tongue 36 extending into the pin-receiving channel 48, while the side extensions 38 slide under the housing overhang portions 46 which define the top of the contact-receiving channel 44. These side extensions 38 are wedged by the projections 42 and 40 in the channel 44 to prevent withdrawal of the contact from the housing. The contact is first inserted into the housing until the rounded projections cause the contact body to bow, which will require only slight insertion force (and may even be done by hand). Thereafter the contact body is driven home under appropriate force (as by machine) until the contact body 26 abuts a shoulder 50 near the end of the contact-receiving channel 44, which shoulder forms a stop for the contact. The terminal 30 is then bent downwardly and rests in a recess or groove 51 in the housing body.

Figure 8:
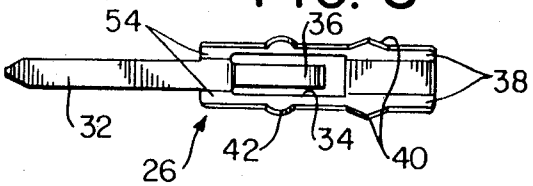
FIG. 8 shows a plan view of the front contact of the connector.

The lower row of contacts of the connector of the invention in housing channels 14 are also formed from the same master contact strip of FIG. 6, by trimming it as shown in FIG. 8, where the terminal portion 32 is to the left of the body 26, which is the same as body 26 of the contact in channel 12. Each such contact is then inserted into a lower channel 14 of the housing, again from the right side, so that the terminal portion 32 now extends freely to the left of the housing, and outwardly from the entrance thereof. The overhang housing portions 46 for each lower channel 14 have a shoulder 52 at the left end which serves as a stop for the ends 54 of the side extensions 38 of the contact body 26 (FIG. 8). Here again, the resilient contact tongue 36 extends freely into the mating-pin-receiving channel 48, while the side extensions 38 of the contact body 26 are under the overlying housing portions 46 and serve to wedge the contact 26 into the contact-receiving channel 44 to inhibit contact removal. After insertion of the lower contacts of FIG. 8, their terminal portions 32 are then bent downwardly to lie in a groove 53 so as to be flush with the entrance side of the housing, as seen in FIG. 2.

The housing 10 is also formed with a series of ribs or ridges 60 formed along its lower surface which serve properly to space the housing from the mounting panel of board 16. The terminals 30, 32 then extend through appropriate openings in the board or panel 16, for connection to wiring on the farside of the board or panel 16.

Figure 9:
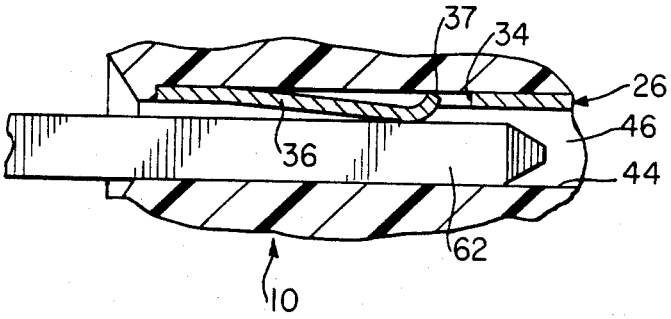
FIG. 9 is a fragmentary cross-sectional view of the connector contact with a mating connector pin in position.

The tongue 36 of the contact 26 is bent upwardly to extend into the pin-receiving channel 12 or 14, so that when the mating connector carrying a number of pins in registry with pin-receiving channels 12 and 14 is inserted from the left, as seen in FIG. 2, or from the front, as seen in FIG. 1, each of the entering pins will slide along the ramp formed by the contact 26, and depress its tongue 36 resiliently, to form an electrical connection between the pin and the tongue 36. FIG. 9 shows a fragmentary view of such a pin 62 in contact with a tongue 36.

As seen in FIG. 9, tongue 36 is curved inwardly at its tip 37. This forms a stop for the tongue 36 when the tip 37 impinges on the inner surface of housing 10, and thereby prevents possible overstressing of tongue 36, and also aids in maintaining good pressure between tongue 36 and pin 62, so as to enhance the electrical contact.

Figure 10:
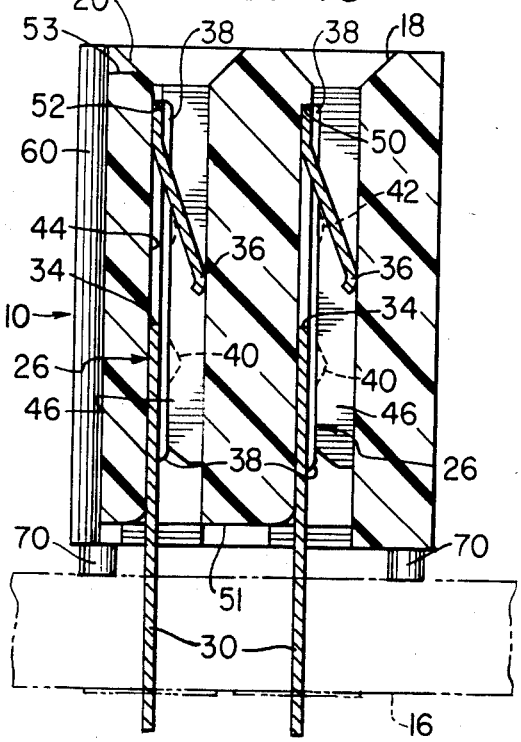
FIG. 10 is an elevation cross-sectional view of a modified connector for vertical mounting, using the same contacts and housing as in the preceding version.

The form of the invention described with respect to FIGS. 1–5 may be called a horizontal-mount connector, since the channels are arranged parallel to the supporting panel, which is normally horizontal, and the pins of the mating connector would similarly be parallel to the panel. However, the contacts of the present invention may also be used with a vertical-mount connector such as illustrated in FIG. 10, using the same housing as for the horizontal-mount connector.

In this instance, both rows of contacts 26 are inserted from the rear, and are identical. They are of the form shown in FIG. 7, with the terminal portions 30 extending rearward from the housing 10, in a direction away from the tapered entries 18. The housing 10 is formed with a series of spacer projections or feet 48 to permit positioning it properly with respect to the panel 16. The terminal portions 30 may then be inserted through the panel or printed circuit board 16, and will have an appropriate spacing, which is the same as that of the pins 62 of the mating connector, shown in FIG. 10 partially inserted into the housing. Where desired, the terminal portions 30 may be positioned in alignment with the mating pins 62, by forming an additional jog or offset in the terminal portions 30 during the stamping or trimming operation. Such a jog is shown at 68 in FIG. 11, which illustrates a form of connector slightly modified with respect to that of FIGS. 1 through 10.

Figure 11:
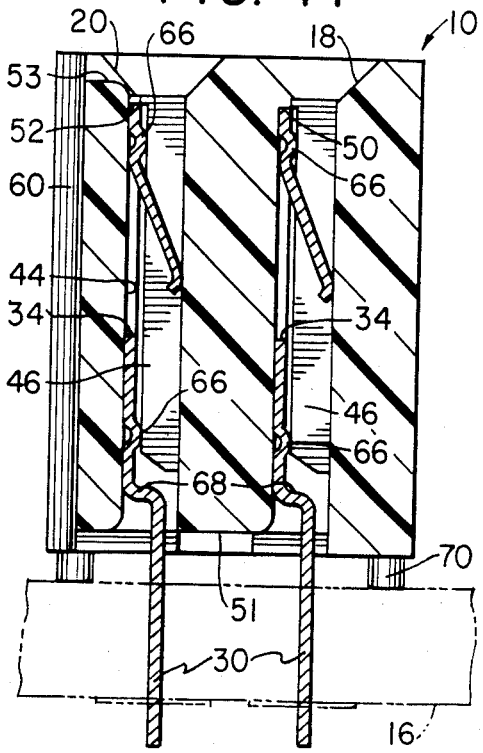
FIG. 11 is a view similar to FIG. 10 of a connector incorporating a modified contact.

In the connector of FIG. 11, in place of the rounded and pointed projections 40, 42 from the sides of the contact body, the body is formed with dimples or transverse ridges 66 extending across the contact body, which cause the contact thickness of the contact body to exceed slightly the thickness of the contact-receiving channel 44, as illustrated in FIG. 11. Then, upon inserting the contact body in channel 44, it becomes wedged between the opposed faces of the channel, to retain the contact in place. It will be understood that the housing 10 of FIGS. 10 and 11 may be the same as that of FIGS. 1–5.

The contact construction of the invention has the particular advantage of having low inductance due to its flat shape. Also, the contacts are readily insertable and strongly retained in the housing. The tongue structure provides an integral overstress prevention.

This arrangement of the invention thus forms a highly efficient and economical construction. The construction is particularly economical with respect to material required, since the strips of FIG. 6 may have the contact formed with a center-to-center spacing of as little as 0.100 inches. Also, only a single-beam type of contact is needed, rather than the conventional box construction which requires much more material. In addition, where gold or similar metal plating is used for corrosion prevention and good electrical contact, only the upper side of the contact tongue as seen in FIG. 2 needs to be plated. Moreover the arrangement of first forming a master contact strip, as showing FIG. 6, readily permits such selective plating. Thus, all of the contact tongues 36 extend outwardly from the general plane of the contact strips of FIG. 6, so that by immersing only the extending contact tongues into a plating electrolyte, selective plating can be accomplished for the tongues alone, after the stamping operation is completed. This avoids the possibility of injuring the plated coating during stamping, and avoids the expense of plating the entire contact strip, whether before or after the multiple stamping operation.

While the present invention has particular advantage in multi-terminal connectors, it will be understood that the invention in certain aspects is also applicable to single-terminal connector.

What is claimed as the invention is:

1. A connector comprising a unitary housing adapted to receive either a front or a rear contact, said front contact having a terminal portion extending outwardly of said housing to the front thereof when mounted in said housing, said rear contact having a terminal portion extending outwardly of said housing to the rear thereof when mounted in said housing, said housing having a first channel adapted to receive a mating connector pin and extending inwardly from a front entry section, a second channel adapted to receive a contact, said contact-receiving channel having a first portion wider than said pin-receiving channel and communicating along at least a portion of its length with said pin-receiving chanel, said contact-receiving channel also having a second portion extending through said front entry section, said second portion being of lesser width than said first contact-receiving channel portion, and said connector further including a contact in said contact-receiving channel, said contact having a terminal portion extending outwardly of said housing through said second contact receiving channel portion.

2. A connector as in claim 1 where said wider contact-receiving channel portion extends outwardly of said housing to the rear thereof.

3. A connector comprising:

a unitary housing adapted to receive either a front or a rear contact, said front contact having a terminal portion extending outwardly of said housing to the front thereof when mounted in said housing, said rear contact having a terminal portion extending outwardly of said housing to the rear thereof when mounted in said housing, said housing having a first channel adapted to receive a mating connector pin and extending inwardly from a front entry section, a second channel adapted to receive a contact, said contact-receiving channel having a first portion wider than said pin-receiving channel and communicating along at least a portion of its length with said pin-receiving chanel, said contact-receiving channel also having a second portion extending through said front entry section, said second portion being of lesser width than said first contact-receiving channel portion, wherein said housing front entry section has a groove extending transversely of said contact-receiving second portion and having a width at least equal to that of said second portion, and adapted to receive the terminal portion of a front contact.

4. A connector comprising:

a unitary housing adapted to receive either a front or a rear contact, said front contact having a terminal portion extending outwardly of said housing to the front thereof when mounted in said housing, said rear contact having a terminal portion extending outwardly of said housing to the rear thereof when mounted in said housing, said housing having a first channel adapted to receive a mating connector pin and extending inwardly from a front entry section, a second channel adapted to receive a contact, said contact-receiving channel having a first portion wider than said pin-receiving channel and communicating along at least a portion of its length with said pin-receiving chanel, said contact-receiving channel also having a second portion extending through said front entry section, said second portion being of lesser width then said first contact-receiving channel portion, wherein said wider contact-receiving channel portion extends outwardly of said housing to the rear thereof, and wherein said housing rear has a groove extending transversely of said contact-receiving channel and of a width less than that of said channel, said groove being adapted to receive the terminal portion of a rear contact.

5. A connector as in claim 3 further including a contact member in said contact-receiving channel, said contact member having a terminal portion extending outwardly through said contact-receiving channel second portion, said terminal portion being bent at substantially 90 degrees to said contact-receiving channel second portion and lying in said groove.

6. A multiple-contact connector having a housing adapted to receive a plurality of either front or rear contacts, said housing having a front entry section, a plurality of first pin-receiving channels each adapted to receive a mating connector pin and extending inwardly from said front entry section, a plurality of second channels each adapted to receive a contact, said contact-receiving channels each having a portion wider than said pin-receiving channel and communicating along at least a portion of its length with said pin-receiving channel, said wider contact-receiving channel portion extending outwardly of said housing to the rear thereof, said contact receiving channels each also having a second portion extending through said front entry section, said second portion being of lesser width than said first contact-receiving channel portion, said connector having a front contact in each of certain of said contact-receiving channels, a rear contact in each of others of said contact-receiving channels, each of said front contacts having a contact body portion with a resilient integral tongue extending into its respective mating-pin-receiving channel and a terminal portion extending from said body portion frontwardly of said housing, each of said rear contacts having a contact body portion with a resilient integral tongue extending into its respective mating-pin-receiving channel, and a terminal portion extending from said body portion rearwardly of said housing.

7. A connector as in claim 6 wherein the height of each of said pin-receiving first channels, between each of said front and rear contact body portions and the corresponding inside walls of said pin-receiving first channels opposite said contact body portions, is just slightly greater than the cross sectional height of a mating connector pin, when said connector pin is inserted into said pin-receiving channel.

* * * * *